US012083600B2

(12) United States Patent
Jones et al.

(10) Patent No.: US 12,083,600 B2
(45) Date of Patent: Sep. 10, 2024

(54) ISOSTATIC PRESSING

(71) Applicant: Rolls Royce plc, London (GB)

(72) Inventors: Gary R Jones, Derby (GB); John L Sulley, Derby (GB); Edward D Warner, Derby (GB)

(73) Assignee: ROLLS-ROYCE PLC, London (GB)

( * ) Notice: Subject to any disclaimer, the term of this patent is extended or adjusted under 35 U.S.C. 154(b) by 83 days.

(21) Appl. No.: 17/179,526

(22) Filed: Feb. 19, 2021

(65) Prior Publication Data

US 2021/0346952 A1 Nov. 11, 2021

(30) Foreign Application Priority Data

Feb. 24, 2020 (GB) ..... 2002538.3

(51) Int. Cl.
*B22F 3/15* (2006.01)
*B22F 5/04* (2006.01)
*B22F 5/10* (2006.01)

(52) U.S. Cl.
CPC ..... *B22F 3/15* (2013.01); *B22F 5/04* (2013.01); *B22F 5/10* (2013.01)

(58) Field of Classification Search
CPC ..... B22F 3/15
See application file for complete search history.

(56) References Cited

U.S. PATENT DOCUMENTS 10,697,465 B2 6/2020 Mola et al.
2011/0027120 A1* 2/2011 Goller ..... B22F 3/1208 419/49
2011/0215510 A1 9/2011 Eriksen
2017/0260997 A1* 9/2017 Mola ..... B22F 5/009
2019/0070665 A1 3/2019 Schloffer

FOREIGN PATENT DOCUMENTS

DE 10 2017 215 321 A1 3/2019
EP 2551040 A1 * 1/2013 ..... B22F 3/1055
GB 2208389 A * 3/1989 ..... B22F 3/1208
GB 2 563 923 A 1/2019
GB 2566496 1/2020
WO 2014/060047 A1 4/2014

OTHER PUBLICATIONS

Okura, Takehiro. "Materials for Aircraft Engines." ASEN 5063 (2015): 1-14. (Year: 2015).*
Jun. 21, 2021 extended Search Report issued in European Patent Application No. 21153149.6.

* cited by examiner

*Primary Examiner* — Jophy S. Koshy
*Assistant Examiner* — Joshua S Carpenter
(74) *Attorney, Agent, or Firm* — Oliff PLC

(57) ABSTRACT

A method of fabricating a component is described and involves retaining a canister as an integral part of the component after performing an isostatic pressing process. The method comprises: providing a canister having a canister wall that encloses an internal cavity, the canister wall comprising at least a first wall section and a second wall section, where the first wall section and the second wall section are of different materials; filling the internal cavity with a powdered material; performing an isostatic pressing process on the filled canister to consolidate the powder; and retaining the canister as an integral part of the component such that an internal structure of the component comprises the consolidated powder and the canister wall forms at least part of a surface of the component that covers the internal structure.

14 Claims, 7 Drawing Sheets

ISOSTATIC PRESSING

CROSS-REFERENCE TO RELATED APPLICATIONS

This application claims priority pursuant to 35 U.S.C. 119(a) of United Kingdom Patent Application No. 2002538.3, filed on Feb. 24, 2020, which application is incorporated herein by reference in its entirety.

BACKGROUND

Field of the Disclosure

The present disclosure concerns methods of manufacturing components using isostatic pressing, and components manufactured using isostatic pressing.

Description of the Related Art

Isostatic pressing is a manufacturing technique involving the consolidation of a powdered material under high pressure conditions. A wide variety of components can be made by isostatic pressing.

The manufacture of a component using isostatic pressing, in particular hot isostatic pressing (known as HIP or HIPing), typically involves the following:

A sacrificial canister, sometimes called a HIP canister, is fabricated. The canister is made of a suitable material, often mild steel, and may be formed by machining a block or by joining together several separate portions of sheet material by welding. The HIP canister has an internal cavity having a shape corresponding to the desired shape of the component that is to be manufactured.

The internal cavity of the HIP canister is filled with a powered material, usually a metal powder or a ceramic power, and then evacuated and sealed.

The sealed canister is subject to a high isostatic pressure and a high temperature (e.g. 100-150 MPa and 1,000-1,300° C.). The combined effect of the high temperature and pressure is to force the HIP canister inward, collapsing the canister and consolidating the powder into a dense component of the desired shape.

The sacrificial HIP canister is removed from the component by a subtractive method, typically machining or acid pickling.

The component may be subject to finishing or further processing, for the example by the addition of a coating or a cladding layer for performance, protection and/or aesthetic reasons.

While the end result of such a process may be acceptable, the process itself can be time consuming. This is especially the case where further processing, such as coating or cladding, is required.

SUMMARY OF THE INVENTION

According to a first aspect there is provided a method of manufacturing a component, the method comprising: providing a canister having a canister wall that encloses an internal cavity, the canister wall comprising at least a first wall section and a second wall section, where the first wall section and the second wall section are of different materials; filling the internal cavity with a powdered material; performing an isostatic pressing process on the filled canister to consolidate the powder; and retaining the canister as an integral part of the component such that an internal structure of the component comprises the consolidated powder and the canister wall forms at least part of a surface of the component that covers the internal structure.

Thus, unlike a conventional process, the canister is not removed after consolidation of the powder and is instead retained as an integral part of the component. Eliminating the need to e.g. acid pickle the component to remove the canister may itself save a significant amount of time. Further, since the canister is being retained to provide a surface of the component, the canister can be adapted prior to the isostatic pressing process so that, after the isostatic pressing process has been performed, the component already has suitable surface properties. For example, if the canister is formed of a cladding material or has already been subject to additive processes (pre-coating, for example), the need to perform further finishing processes such as coating and cladding on the component may be reduced or eliminated. This may save a significant amount of time in the manufacture of the component.

At least a section of the canister wall of the provided canister may be provided for use as cladding of the component such that, after performing the isostatic pressing process, at least part of the component is clad. The section provided for use as cladding may comprise stainless steel, a nickel based alloy, an aluminide, a ceramic, aluminium or chromium.

At least a section of the canister wall of the provided canister may be provided pre-coated such that, after performing the isostatic pressing process, at least part of the component is coated. The coating may include any one or more of a hydrophobic coating, an aluminide coating, a coating comprising aluminium or chromium, a ceramic coating or a coating of another type.

The canister wall comprises at least a first wall section and a second wall section, the first and second wall sections are made of different materials thus tending to have different material properties.

The component may be a blade, for example a turbine blade, for a gas turbine engine.

The component may be or may form a part of a vessel, for example a pressure vessel. In this case the canister wall may comprise at least a first wall section and a second wall section opposite the first section, at least a part of the internal cavity being defined between the first and second wall sections. The first wall section of the retained canister may form part of an external surface of the vessel and the second wall section of the retained canister may form part of an internal surface of the vessel. The second wall section may be formed of or coated in a corrosion resistant material.

Providing the canister may comprise fabricating the canister. Fabricating the canister may comprise welding together a plurality of wall sections, which may be made of different materials or have different material properties (different coatings, for example).

One or more further components may be placed in the internal cavity of the canister before the internal cavity is filled with a powdered material.

The one or more further components may comprise a metal plate.

Performing the isostatic pressing process may comprise sealing the filled canister and subjecting the filled canister to high pressure conditions. In some examples the isostatic pressing process is a hot isostatic pressing (HIP) process and the sealed canister is also subject to high temperature conditions.

According to a second aspect, there is provided a component formed by isostatic pressing. The component comprises: an internal structure comprising a consolidated powder; and an outer surface covering the consolidated powder internal structure. The outer surface comprises or is formed from a canister wall of a canister used to contain a powder while the powder is consolidated during an isostatic pressing process and retained as an integral part of the component. The canister wall comprises at least a first wall section and a second wall section, where the first wall section and the second wall section are of different materials.

The component may be a blade, for example a turbine blade, for a gas turbine engine.

The component may be or may be a part of a vessel (for example a pressure vessel) having an external surface and internal surface. At least part of the external surface may be formed from a first wall section of the canister wall of the retained canister and at least part of the internal surface may be formed from a second wall section of the canister wall of the retained canister. The first and second wall sections may have different material properties.

At least a section of the canister wall may be of a cladding material.

The term "canister" as used herein is not intended to be limited to any particular shape. The canister may have any suitable shape, including non-cylindrical shapes and complex shapes.

The term "component" as used herein may refer to a wide variety of components, including pressure vessels used in a number of industries and components of gas turbine engines such as turbine blades and bladed discs.

The term "isostatic pressing" encompasses Hot Isostatic Pressing (HIP) as well as Warm Isostatic Pressing (WIP) and Cold Isostatic Pressing (CIP) which take place at lower temperatures. WIP and CIP typically make use of flexible moulds as canisters, for example moulds made of elastomers or polymers though a metal of relatively thin section could also be used.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF THE DRAWINGS

Embodiments will now be described by way of example only, with reference to the Figures, in which.

DETAILED DESCRIPTION OF THE DISCLOSURE

Figure 1B:
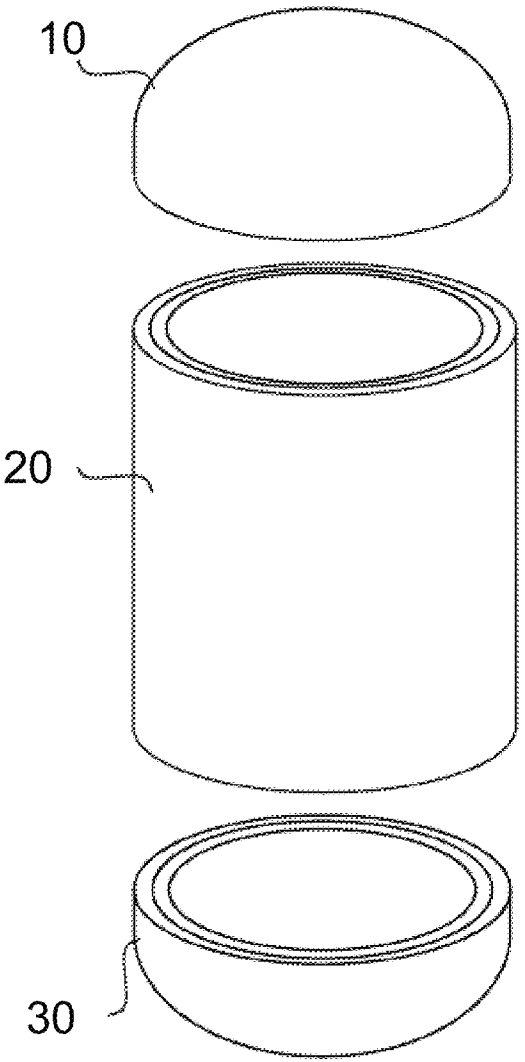
FIG. 1B is an exploded view of the of the pressure vessel of FIG. 1A.
Figure 1A:
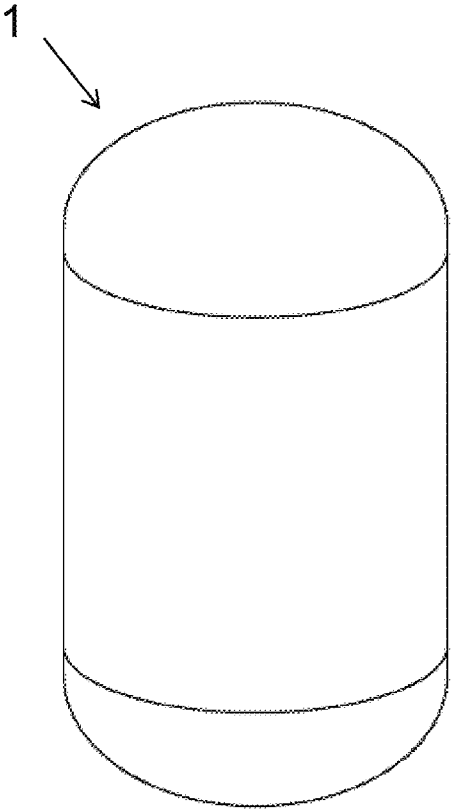
FIG. 1A is a perspective view of a component, in particular a pressure vessel.

A component 1, in particular a pressure vessel 1 such as may be used in a variety of industrial applications, is illustrated in FIG. 1A. As can be appreciated from the exploded view in FIG. 1B, the pressure vessel 1 is formed from three portions, a top dome portion 10, a middle cylindrical portion 20 and a bottom dome portion 12. Each of the three portions 10, 20, 30 is a shell such that when the three portions 10, 20, 30 are joined together the pressure vessel 1 is hollow with an interior chamber. Other pressure vessels may be formed from greater or fewer than three portions and the portions may be of different shapes.

The pressure vessel 1 could, conventionally, be manufactured in a number of different ways. For example, each of the three portions 10, 20, 30 may be cast or forged separately, and the portions welded together by laser welding, Tungsten Inert Gas (TIG) welding, Metal Inert Gas (MIG) welding or the like. In many cases further processes are performed on the vessel 1 prior to or after the portions 10, 20, 30 are welded together. For example, as described in UK Patent GB 2566496 B, the interior surface of a pressure vessel 1 may be lined with a corrosion-resistant layer, often referred to as cladding. These additional processes may take a considerable amount of time: it may take as long as eighteen months to complete the cladding of a large pressure vessel.

Aspects of the present disclosure may significantly reduce the amount of time required to manufacture and finish components, such as a pressure vessel 1, by retaining a canister used in an isostatic pressing process (for example a HIP process) as an integral part of the component. This is described in more detail below with reference to FIGS. 2A-D, 3A-D and 4. It is to be understood that while the manufacture of a component 10 of a pressure vessel 1 by hot isostatic pressing is described, the present disclosure is not so limited and other kinds of component can be manufactured using the techniques described herein. This includes various types of vessels (for example those used in power plants, in the food industry, in the brewing industry, in the pharmaceutical industry as well as in the oil, gas and nuclear industries) and components found in, for example, gas turbine engines such as turbine blades and blisks, as well as manufacture of components by CIP or WIP.

Figure 2B:
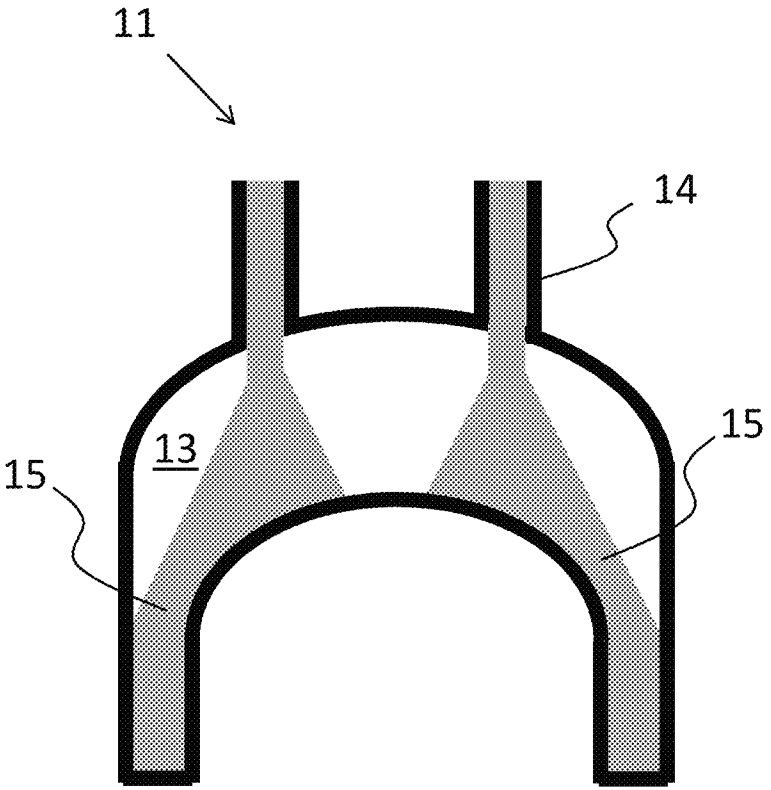
FIG. 2B is a cross-sectional view of the HIP canister of FIG. 2A being filled with a powder prior to isostatic pressing.
Figure 2A:
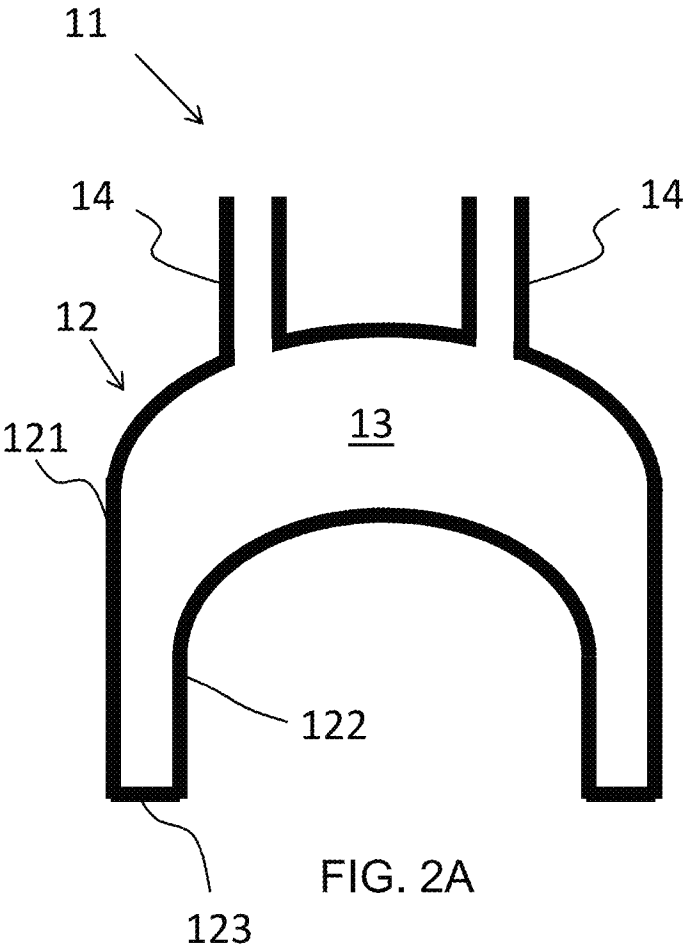
FIG. 2A is a cross-sectional view of a canister.

FIG. 2A shows in cross-section a canister 11 for use in the manufacture of a component 10, in particular the manufacture of the top dome portion 10 of the pressure vessel 1 of FIGS. 1A-B. The canister 11 has a canister wall 12 which encloses an internal cavity 13. In this particular case the canister 11 may be considered to be formed of first and second dome-shaped wall sections 121, 122 joined by an annular intermediate wall section 123.

The canister 11 can be fabricated in any suitable way, for example by the welding together of several sheet-metal sections. For instance, three sheet-metal sections corresponding to the three wall sections 121, 122, 123 may be welded together to the form the wall 12 of the canister 11. In other cases the canister 11 may be fabricated by machining a block of material.

FIG. 2B shows the internal cavity 13 of the canister 11 being filled with a powdered material 15 through filling pipes 14, though the canister 11 could filled with the powder 15 in any suitable way. The powdered material 15 is a powder suitable for hot isostatic pressing, typically a metal or ceramic powder as is known in the art.

Once the internal cavity 13 has been filled with powder 15, the cavity 13 is evacuated to remove any remaining air and the canister 11 is sealed, for example by mechanical crimping or welding. The filled, sealed canister 11 is then placed in a HIP consolidation chamber (not shown) where it is subject to high temperatures and pressures in order to collapse the canister 11 and consolidate the powder 15 into a denser form. As is known in the art, the temperature, pressure and duration of time required to complete the HIP process will depend on the size and geometry of the component and the selected powder material, amongst other things. By way of an example, the filled canister 11 may be subject to a pressure of about 150 MPa and a temperature of about 1,000° C. for about 5 hours. The filling pipes 14, if used, are typically removed after the hot isostatic pressing process is complete.

Figure 2D:
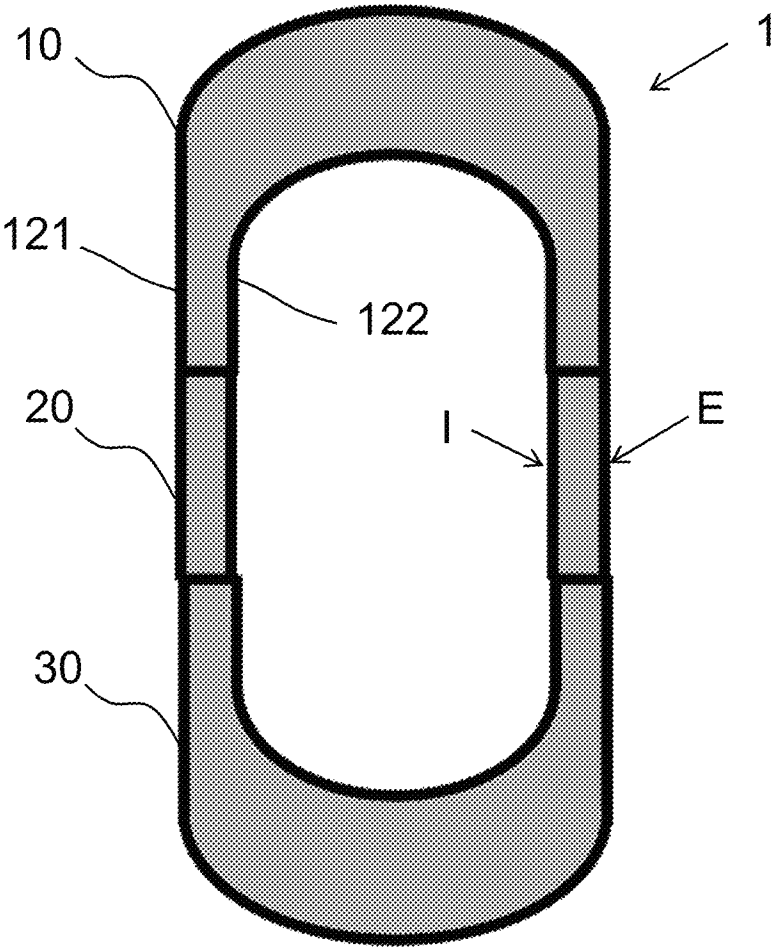
FIG. 2D is a cross-sectional view of three components joined together to form the pressure vessel of FIGS. 1A-1B.
Figure 2C:
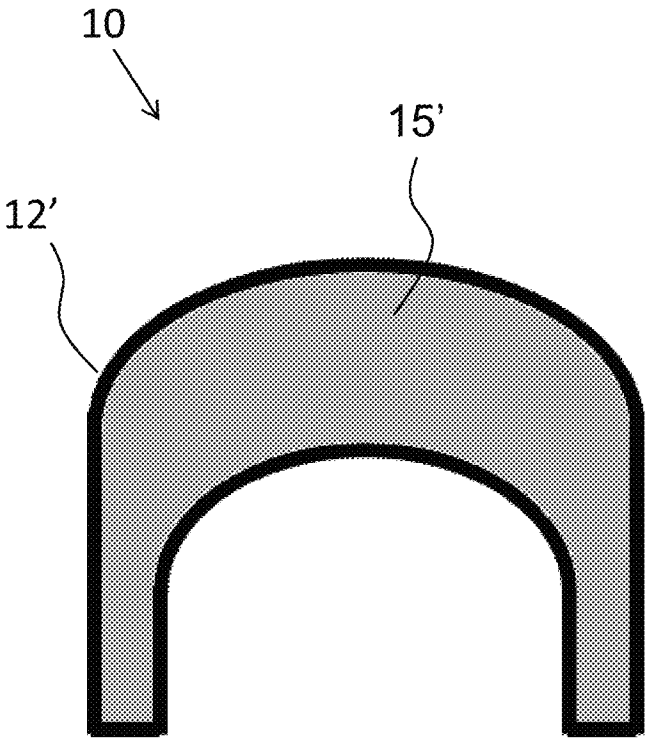
FIG. 2C is a cross-sectional view of a component retaining the canister of FIGS. 2A-2B as an integral part of its structure.

FIG. 2C shows the component 10, namely the top dome portion 10 of the pressure vessel 1, resulting from the HIP process. As can be seen, the component 10 has an internal structure 15' provided by the consolidated powder. Further, the high temperatures and pressures of the HIP process have caused the collapsed canister to HIP diffusion bond to the internal structure 15' so as to provide a surface 12' covering the internal structure 15'.

In a conventional HIP manufacturing process, the collapsed HIP canister 12, which would typically be made of mild steel, would be removed by acid pickling to leave a component formed solely of consolidated powder. According to the present disclosure, however, the collapsed HIP canister 12 is retained as an integral part of the component 10. In particular, the collapsed HIP canister 12 forms a surface of the component 10.

FIG. 2D shows in cross-section the pressure vessel 1 of FIGS. 1A-1B formed by joining (e.g. welding) together the three portions 10, 20, 30. In this case each of the three portions 10, 20, 30 was formed as described above for the top dome portion 10, such that each of the portions 10, 20, 30 has an internal structure in the form of consolidated HIP powder and a surface, provided by the retained HIP canister, covering the internal structure.

With the three portions 10, 20, 30 welded together, it can be more readily appreciated that the first dome-shaped wall section 121 of the canister wall 12 has become part of the exterior surface (E) of the vessel 1. Similarly, it can be appreciated that the second dome-shaped wall section 122 of the canister wall 12 has become part of the interior surface (I) of the vessel 1. Thus, the material properties of the surfaces (I, E), for example their corrosion resistances can, conveniently, be selected by providing a HIP canister 11 with a canister wall 12 of suitable construction and having suitable material properties. For example, by fabricating a canister 11 with a second wall 122 made from a suitable cladding material, such as stainless steel (e.g. 316L stainless steel) or a nickel based alloy, the vessel 1 will have a clad interior surface (I) without the further need to perform a dedicated cladding process on the interior surface.

It should therefore be appreciated that by providing a canister 11 that, as well as having a shape suitable for HIPing the desired component 10, has wall sections with material properties corresponding those to the desired end-product, retaining the canister 11 as an integral part of the component may allow for the production of a component 10 having desired surface properties with a substantially reduced manufacturing time.

FIGS. 3A-3E show in cross-section portions of components 10*a*-10*e* made according to the present disclosure, with a HIP canister 11 retained as an integral part of the component 10. In each case an internal structure 15' in the form of consolidated powder is covered by a surface 12' formed from sections of the canister wall 12 of the HIP canister. The examples of FIGS. 3A-3E illustrate some of the possible combinations of wall sections that make up the canister wall 11 of the canister 12.

It is to be understood that while the portions of the wall sections illustrated in FIGS. 3A-E are straight and arranged parallel or perpendicular to each other, this is only of ease of illustration and explanation. The wall sections that make up the canister wall 12 may be straight, curved, parallel, non-parallel and a mixture of all of these, as is the case with the canister walls 121, 122 in FIGS. 2A-2D.

Figure 3A:
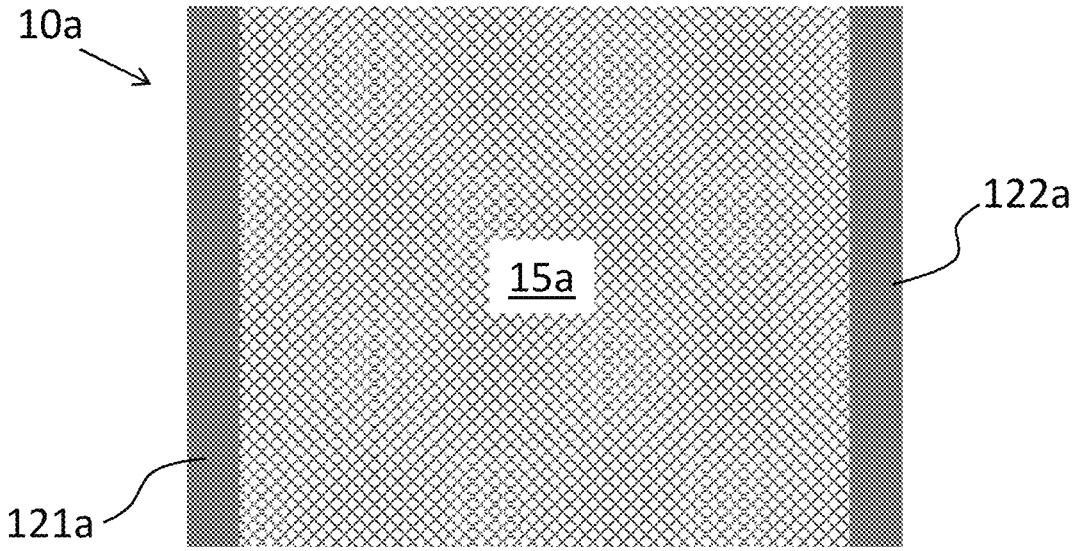
FIGS. 3A-3E are schematic diagrams illustrating different canister wall arrangements; and, FIG. 4 is a flow diagram illustrating a method of manufacturing a component.

FIG. 3A illustrates a first example of a component 10*a*. The component 10*a* has a consolidated powder internal structure 15*a* in a cavity that is defined between opposing first and second wall sections 121*a*, 122*a* of the retained canister 11. FIG. 3A illustrates that some or all of the wall sections 121*a*, 122*a* of the canister wall 12 may be the same. For example, the wall sections 121*a*, 122*a* may be of the same thickness, the same material and may have been subject to the same finishing processes (e.g. the same coating may have been pre-applied by spraying or the like).

The material properties (e.g. material, finish) may have been selected so that one of the surfaces, for example the surface provided by the second wall section 122*a*, has particular desirable properties, for example corrosion resistance. An identical material and thickness may then have been chosen for the other wall section 121*a* for convenience, for example due to the ease of fabricating a canister 11 from a single material. By way of a particular example, the intended application of the component 10*a* may require that the surface provided by wall section 122*a* is clad for corrosion resistance. Due to this requirement, wall section 122*a* may have been made of 6 mm thick 316L stainless steel. Wall section 121*a* is then also made of 6 mm 316L stainless steel because it is an acceptable choice of material for the surface provided by the first wall section 121*a* and because it is generally easier to weld sections made of identical materials.

Figure 3B:
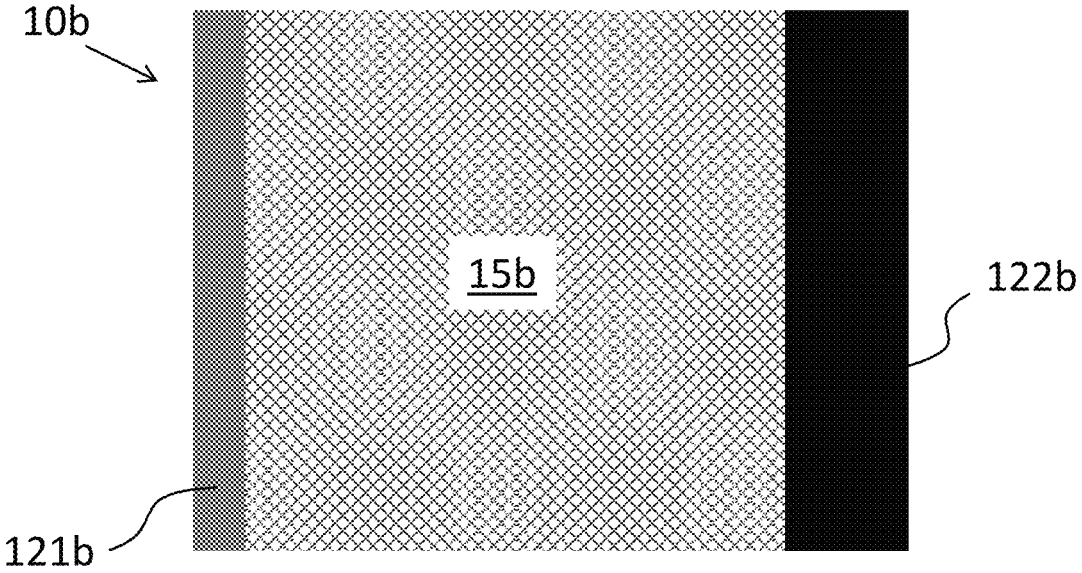

FIG. 3B illustrates another example of a component 10*b*. The component 10*b* has a consolidated powder internal structure 15*b* in a cavity that is defined between opposing first and second wall sections 121*b*, 122*b* of the retained canister 11. FIG. 3B illustrates that the wall sections 121*b*, 122*b* of the canister 11 may have different material properties. In FIG. 3B the first wall section 121*b* is made of a first material and of a first thickness, whereas the second wall section 122*b* is of a second, different material and has second, a different thickness.

By way of a specific example, the surface provided by the first wall section 121*b* may be made of 6 mm thick mild steel, and the second wall section 122*b* may be made of a 10 mm thick corrosion resistance nickel alloy. The second wall section 122*b* may also have been pre-coated with, for example, a hydrophobic coating, an aluminide coating, a coating comprising aluminium or chromium, a ceramic coating or a coating of another type.

Figure 3C:
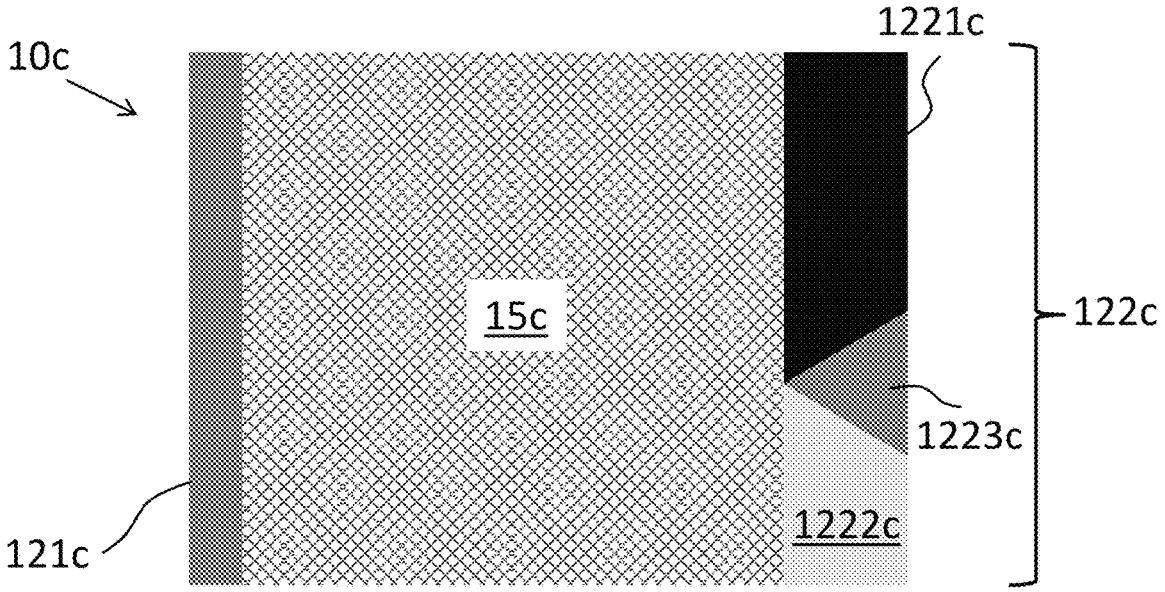

FIG. 3C illustrates another example of a component 10*c*. The component 10*c* has a consolidated powder internal structure 15*c* in a cavity that is defined between opposing first and second wall sections 121*c*, 122*c* of the retained canister 11. FIG. 3C illustrates that a wall section may be formed from multiple sub-sections that have different material properties. In particular, in FIG. 3C, the second wall-section 122*c* includes a first sub-section 1221*c* and a second sub-section 1222*c* that has different material properties.

In FIG. 3C the first and second sub-sections 1221*c*, 1222*c* are of different materials, and are joined together by a weld 1223*c*, which may be of the same material as one of the first and second sub-sections 1221*c*, 1222*c* or a different material still. Other possibilities will occur to those skilled in the art. For example, the two sub-sections 1221*c*, 1222*c* may be of the same material, with no joining weld 1223*c*, but one of the sub-sections 1221*c* may have been pre-coated so that a portion of the surface of the component 10*c* is coated.

Figure 3D:
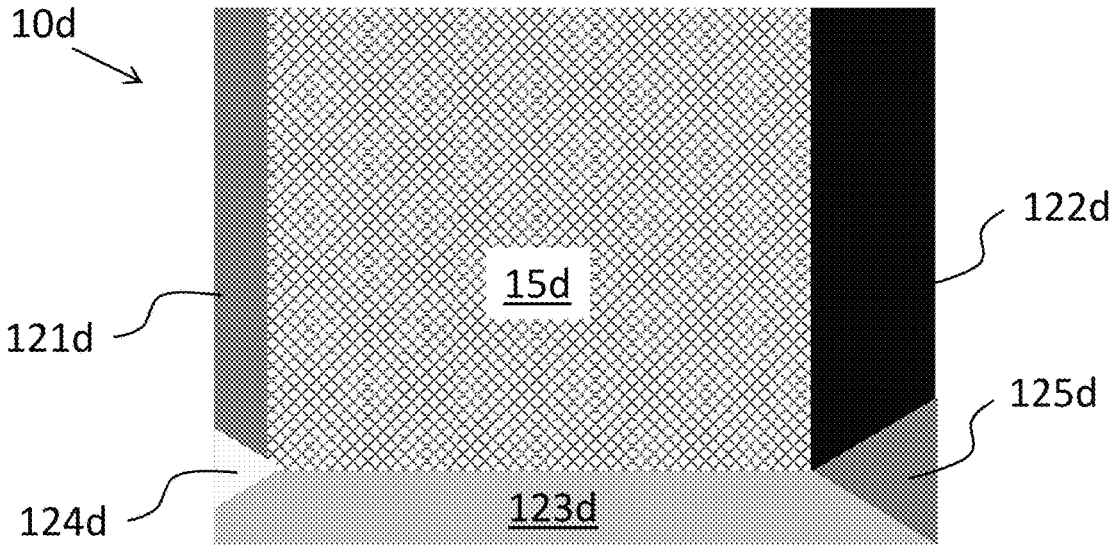

FIG. 3D illustrates another example of a component 10*d*. The component 10*d* has a consolidated powder internal structure 15*d* in a cavity that is defined between opposing first and second wall sections 121*d*, 122*d* and a third intermediate wall section 123*d* of the retained canister 11. FIG. 3D illustrates that the different sections 121*d*, 122*d*, 123*d*, which in this case each have different material properties, can be joined together, for example by welds 124*d*, 125*d*.

In FIG. 3D, each of the three wall sections 121*d*, 122*d*, 123*d* are of different materials and different thicknesses. The first wall section 121*d* and the third wall section 123*d* are joined together by a weld 124*d*, which may be of a weld material that is the same as one of the materials of the first and third wall sections 121*d*, 123*d* or a different material still. The second wall section 122*d* and the third wall section 123*d* are joined together by a weld 125*d*, which may be of a weld material that is the same as one of the materials of the second and third wall sections 122*d*, 123*d* or a different material still.

Figure 3E:
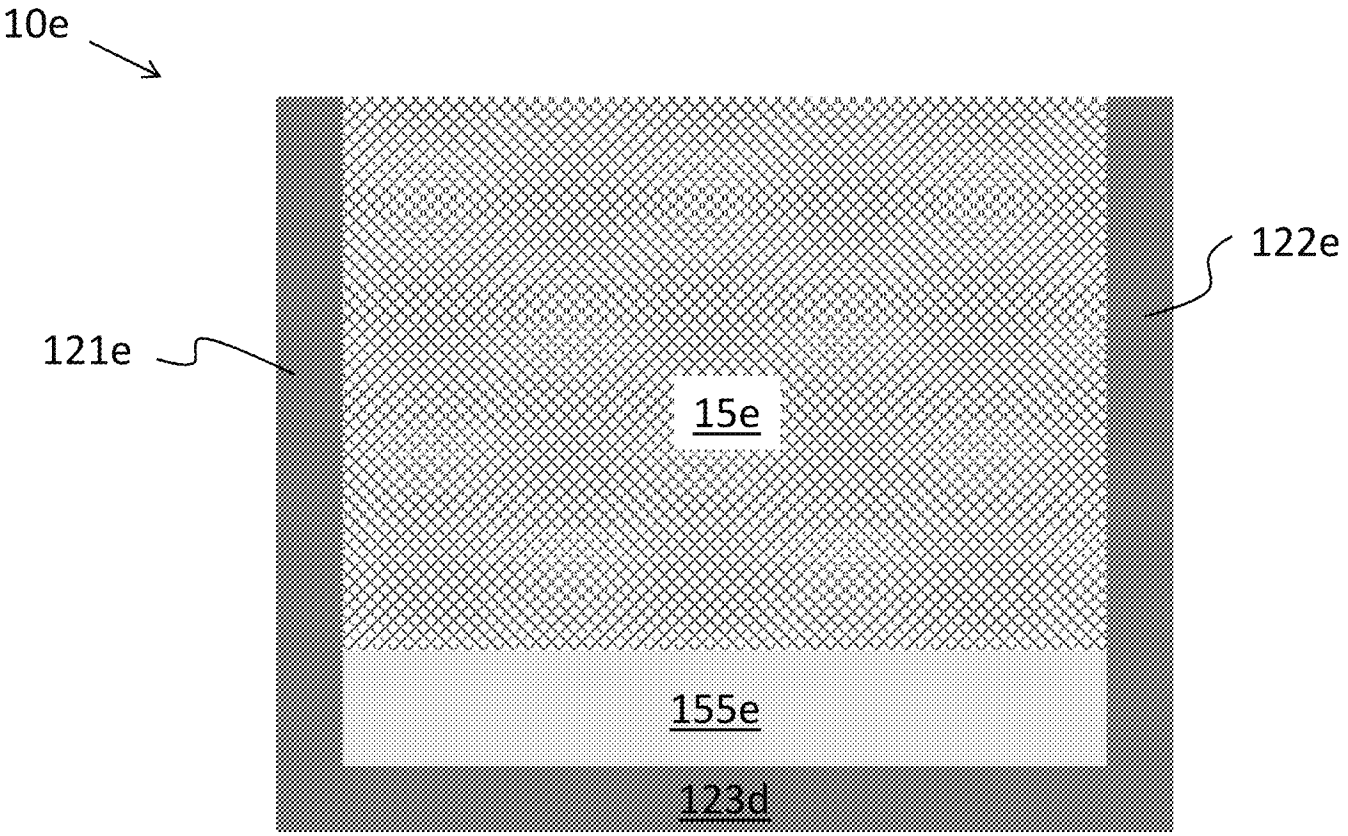

FIG. 3E illustrates another example of a component 10*e*. The component 10*e* has an internal structure comprising consolidated powder 15*e* in a cavity that is defined between opposing first and second wall sections 121*e*, 122*e* and a third intermediate wall section 123*e* of the retained canister 11. FIG. 3E illustrates that the internal structure 15' of a component is not necessarily solely consolidated powder 15*e*. For example, prior to filling the internal cavity 13 of the canister 11 with powder, one or more further components 155*e* may be positioned in the internal cavity 13 so that the internal structure 15' includes the further component 155*e* as well as the consolidated powder 15*e*. In this particular example the further component 155*e* is a metal plate, which may be a similar or dissimilar material to the HIP canister 11, serving as an additional material layer of the component 10*e*.

To summarise FIGS. 3A-3E, the canister 11 has a canister wall 12 that includes one or more wall sections 121, 122, 123. Some or all of the wall sections may be identical, whereas others may be different. For example, wall sections may have different thicknesses or different material properties, for example different materials, or identical or different materials that have been subject to different finishing processes such as the application of coatings. Adjacent wall sections of the canister wall 12 may be integral with each other (for example if bent from a sheet or machined from a block) or joined together by a welding process. Individual wall sections may also be formed from a plurality of wall sub-sections with different material properties or thicknesses. The thickness and material properties of the sections of the canister wall 12 may be selected according to the desired properties of the final component, for example the need for one or more surfaces of the component to be clad or coated.

Figure 4:
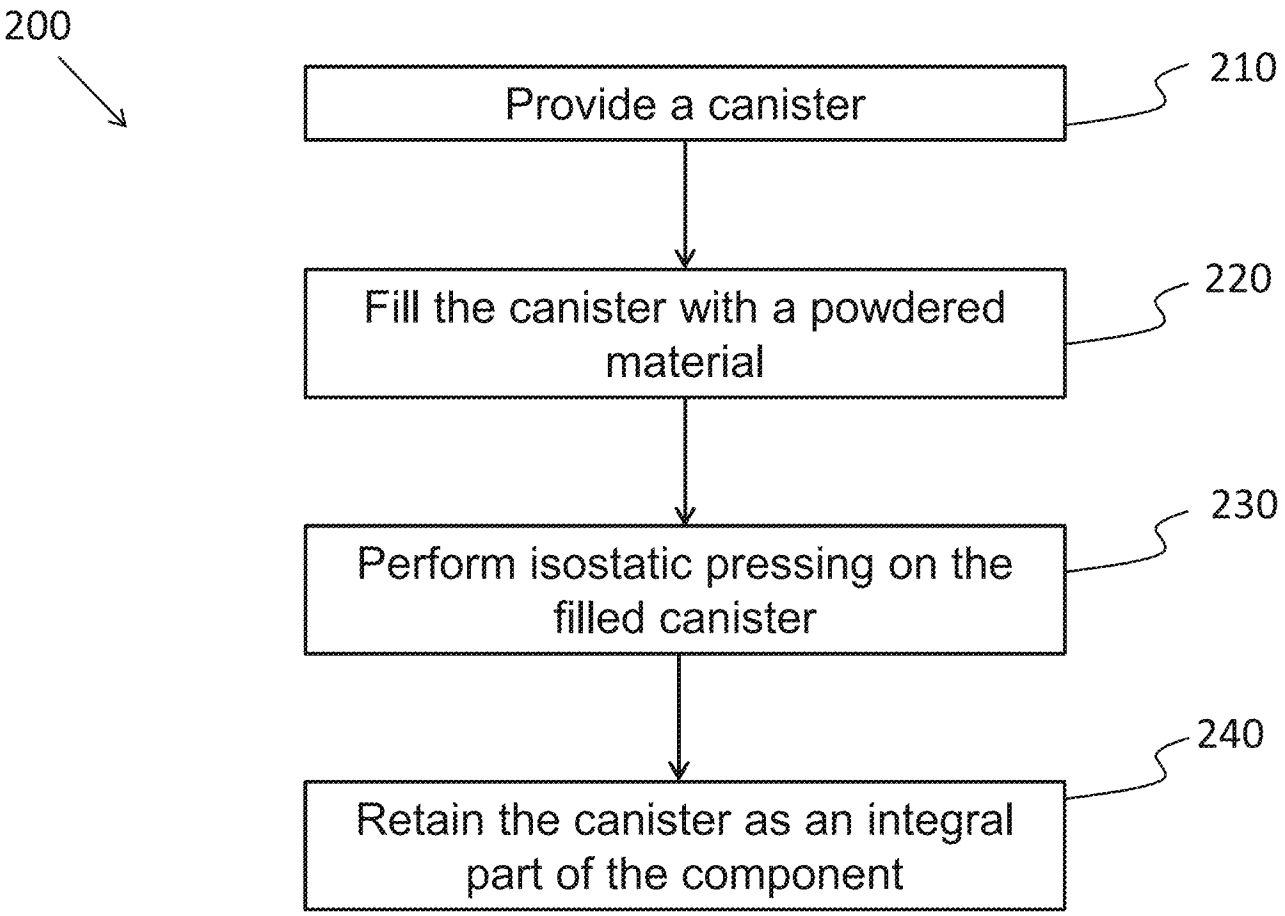

Now turning to the flow chart of FIG. 4, this illustrates a method of fabricating a component in accordance with the present disclosure.

At 210, a canister 11 is provided. The canister 11 has a canister wall 12 which encloses an internal cavity 13. The canister wall 12 and the internal cavity 13 may be of any size and shape based on the size and shape of the component 10 that is to be manufactured.

The canister wall 12 may be considered to have one or more wall sections 121, 122, 123. The material properties and thicknesses of the wall sections may be selected so as to provide the final component with a surface having desired properties. For example, if a surface (e.g. an interior surface of a pressure vessel) of the final component should be clad with a corrosion resistant layer, a wall section 122 of the canister 11 corresponding to that surface of the final component 10 may be formed of a suitable material, for example stainless steel or a nickel based alloy. Other suitable materials may include aluminides, materials comprising aluminium and/or chromium, and ceramics.

The step 210 of providing the canister 11 may include fabricating the canister 11. For example, based on the size, shape and desired properties of the component 10, wall sections of appropriate materials, thicknesses and sizes may be selected and obtained. Processes, for example coating processes, may also be performed on the wall sections. Then, when the appropriate wall sections have been obtained, the canister 11 may be fabricated by joining the wall sections together, for example by welding.

At 220, the internal cavity 13 of the canister 11 is filled with an appropriate powder. The powder will be selected according to application requirements and will, generally, be a metal powder such as aluminium powder or a ceramic powder. The canister 11 can be filled in any suitable way known in the art, for example through one or more filling pipes in communication with one or more filling points of the canister 11.

At 230, an isostatic pressing process is performed. This will first involve sealing the filled canister by, for example, welding the canister closed, crimping of the filling pipes or any other suitable process. Any remaining unfilled volume of the canister 11 may be evacuated prior to and during the sealing process. Once sealed, the filled canister 11 can be introduced into a consolidation chamber as is known in the art. The consolidation chamber subjects the filled canister 11 to high pressures and, in the case of HIP, high temperatures, typically of the order of 1,000-1,300° C. and 100-150 MPa. The high temperatures and pressures causes the powder 15 to consolidate into a denser, solid form and for the canister wall 12 to collapse into the consolidated powder and form a HIP diffusion bond with the consolidated powder or cold/hot sinter to the consolidated powder. Once the isostatic pressing process is complete, the canister 11 is removed from the consolidation chamber.

At 240, the canister 11 is retained as an integral part of the final component 10. That is, rather than removing the canister wall 12 by a subtractive process such as acid pickling, the canister 11 is retained and the wall 12 forms a surface 12' of the final component 10. In this way, the surfaces 12' of the component retain the material properties of the corresponding wall sections of the canister wall 12. The final component has a consolidated powder internal structure 15' that is covered by a surface 12' provided by the collapsed canister wall 12.

It will be understood that the term "canister" as used herein is not intended to be limited to any specific geometry. In particular, while the term "canister" may generally suggest a cylindrical shape, a canister according to this disclosure need not be cylindrical, and could have one of any number of complex shapes, as can be appreciated from the canister 11 of FIG. 2A. As used herein, a "canister" or "HIP canister" is a container that has an internal cavity for receiving powder and which is suitable for use in an isostatic pressing process.

It will be understood that while the above description generally refers to pressure vessels, other components could be fabricated according to the techniques described herein.

For example, a turbine blade, bladed disk or other engine component could be manufactured as described herein. Where the component is a vessel or part of a vessel, the vessel may be made of any number of portions and may have any number of suitable shapes and sizes.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A method of manufacturing a component, the method comprising the steps of:

providing a canister that encloses an internal cavity, the canister comprising at least a first wall and a second wall, wherein:

the first wall and the second wall are of different materials;

the first wall has only one first thickness throughout an entire length of the first wall that is different than only one second thickness throughout an entire length of the second wall; and at least a section of the canister that is provided is pre-coated;

filling the internal cavity with a powdered material;

performing an isostatic pressing process on the canister that is filled to consolidate the powdered material; and retaining the canister as an integral part of the component such that an internal structure of the component comprises the consolidated powder material and the canister forms at least part of a surface of the component that covers the internal structure, wherein: the at least the section of the canister is provided pre-coated such that, after performing the isostatic pressing process, at least part of the component is coated.

2. The method of claim 1, wherein at least a section of the canister is provided for use as cladding of the component such that, after performing the isostatic pressing process, at least part of the component is clad.

3. The method of claim 1, wherein the component is a blade for a gas turbine engine.

4. The method of claim 1, wherein the component is or forms part of a vessel.

5. The method of claim 1, wherein providing the canister comprises fabricating the canister.

6. The method of claim 1, wherein one or more further components is or are placed in the internal cavity of the canister before the internal cavity is filled with a powdered material.

7. The method of claim 1, wherein performing the isostatic pressing process comprises sealing the canister that is filled and subjecting the canister that is filled to high pressure conditions from 100-150 MPa.

8. The method of claim 1, wherein the first wall is made of steel, the second wall is a nickel alloy and the coating is a hydrophobic coating, an aluminide coating, a coating comprising aluminium or chromium, or a ceramic coating.

9. The method of claim 1, wherein the second wall includes a first sub-section and a second sub-section that have a same thickness and have different material properties and that are joined together by a weld.

10. The method of claim 1, wherein the canister comprises a third wall that connects the first wall to the second wall and has a third thickness that is different than the first thickness and the second thickness.

11. The method of claim 2, wherein the section provided for use as cladding comprises stainless steel, a nickel based alloy, an aluminide, a ceramic, aluminium or chromium.

12. The method of claim 4, wherein the second wall is opposite the first wall, at least a part of the internal cavity being defined between the first wall and the second wall, and wherein the first wall of the canister that is retained forms part of an external surface of the vessel and the second wall of the canister that is retained forms part of an internal surface of the vessel.

13. The method of claim 12, wherein the second wall is formed of or coated in a corrosion resistant material.

14. The method of claim 6, wherein the one or more further components comprises a metal plate.

* * * * *